US007510243B1

(12) United States Patent
Hung

(10) Patent No.: US 7,510,243 B1
(45) Date of Patent: Mar. 31, 2009

(54) FOLDING AND FIXING STRUCTURE OF A CHAIR BACKREST

(76) Inventor: Yu-Ching Hung, 11F.-4, No. 130, Jingcheng Rd., West District, Taichung City 40352 (TW)

( * ) Notice: Subject to any disclaimer, the term of this patent is extended or adjusted under 35 U.S.C. 154(b) by 0 days.

(21) Appl. No.: 11/964,035

(22) Filed: Dec. 25, 2007

(51) Int. Cl.
*B60N 2/02* (2006.01)

(52) U.S. Cl. ..... 297/378.12; 297/378.1; 297/463.1; 16/326

(58) Field of Classification Search ..... 297/51, 297/53, 353, 378.1, 378.12, 440.21, 463.1; 16/326, 321, 324, 352
See application file for complete search history.

(56) References Cited

U.S. PATENT DOCUMENTS 1,326,275 A * 12/1919 Koerner ..... 297/317
1,821,417 A * 9/1931 Bounds ..... 297/307
4,608,729 A * 9/1986 Huang ..... 16/35 R
5,364,165 A * 11/1994 Okamoto ..... 297/364
5,520,441 A * 5/1996 Citton ..... 297/440.21
5,533,786 A * 7/1996 Cone, II ..... 297/256.15
6,450,580 B1 * 9/2002 Drew et al. ..... 297/378.12
6,536,079 B2 * 3/2003 Hill ..... 16/326
6,631,958 B1 * 10/2003 Herrmann et al. ..... 297/463.1
6,715,841 B2 * 4/2004 Christoffel et al. ..... 297/463.1
6,729,692 B1 * 5/2004 Chou ..... 297/463.1

* cited by examiner

*Primary Examiner*—Laurie K Cranmer
(74) *Attorney, Agent, or Firm*—Banger Shia

(57) ABSTRACT

A folding and fixing structure of a chair backrest, both sides of one end of the backrest are disposed with a pivotal member having a pivotal portion and a locking portion, respective. The pivotal portions are pivotally disposed on two armrests. The armrests are defined at a side of their opposite surfaces with a containing portion for containing a clutch structure, respectively. Since the backrest is rotated around and is moved with respect to the pivotal portions of the pivotal members, the locking portions of the pivotal members will be slid into the containing portions of the armrests and can be restricted by or disengaged from the clutch structures. Thereby, the backrest can be folded or unfolded stably, such that the chair will occupy less space after being folded and can be assembled quickly.

4 Claims, 7 Drawing Sheets

FOLDING AND FIXING STRUCTURE OF A CHAIR BACKREST

BACKGROUND OF THE INVENTION

1. Field of the Invention

The present invention relates to a folding and fixing structure of a chair backrest, and more particularly to a folding and fixing structure of a chair backrest which can be folded or unfolded stably and can be assembled quickly by disposing rotatably folded locking structures between the backrest and the armrests.

2. Description of the Prior Art

Conventional office chairs are unfoldable, so the sizes of the office chairs 90 cannot be reduced at any time. Referring to FIG. 1, the conventional office chair 90 comprises a seat 91. A column-shaped supporting body 92 is mounted on a center of a bottom of the seat 91 and is jointed with a base 93 having a plurality of wheels. An arc-shaped positioning board 94 is fixing on a bottom edge of the seat 91, and one end of the positioning board 94 is fixing with a backrest 95. Such a conventional office chair 90 needs to be improved.

An improved folding structure of a chair is disclosed in US Serial No. 20020041121, wherein between the backrest and the seat of the chair is pivotally disposed a board having a sliding groove. The sliding groove allows for relative slide between the structures of the backrest and the seat, such that the backrest and the seat are parallel to each other after being folded (can be folded to be parallel to each other). Other related patents, such as U.S. Pat. Nos. 579,308, 4,652,051 and 4,779,926, and US Serial Nos. 20030025375 and 20020079728 disclose the improved folding structure of the chair. Thereby, a chair backrest which can be folded or unfolded stably to facilitate the folding and reduction of the size of the chair is developed.

The present invention has arisen to mitigate and/or obviate the afore-described disadvantages.

SUMMARY OF THE INVENTION

The present invention is to provide a folding and fixing structure of a chair backrest which can be folded or unfolded stably, so as to facilitate the folding and to reduce the size of the chair.

The primary objective of the present invention is to provide a folding and fixing structure of a chair backrest. Both sides of one end of the backrest are disposed with a pivotal member, respectively. A pivotal portion and a locking portion are extended from one end surface of each pivotal member, and the pivotal portions are pivotally disposed on two armrests. Each armrest is disposed with a clutch structure having a clutch member adjacent to the pivotal position. Each clutch member is disposed with a clutch portion extending from the armrest. Thereby, the backrest is rotated around and is moved with respect to the pivotal portions pivotally disposed on the armrests, and since the locking portions of the pivotal members are slid in and are restricted by the clutch members disposed in the armrests, the backrest can be vertical to a seat. In addition, when the user unfolds the backrest, only by pushing the clutch portions of the clutch members to one end to separate the locking portions of the pivotal members from the armrests, the backrest and the seat are paralleled to and abutted against each other between the armrests.

With the above-mentioned structures, the backrest can be folded or unfolded stably, such that the chair will occupy less space after being folded and it is easy to operate.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
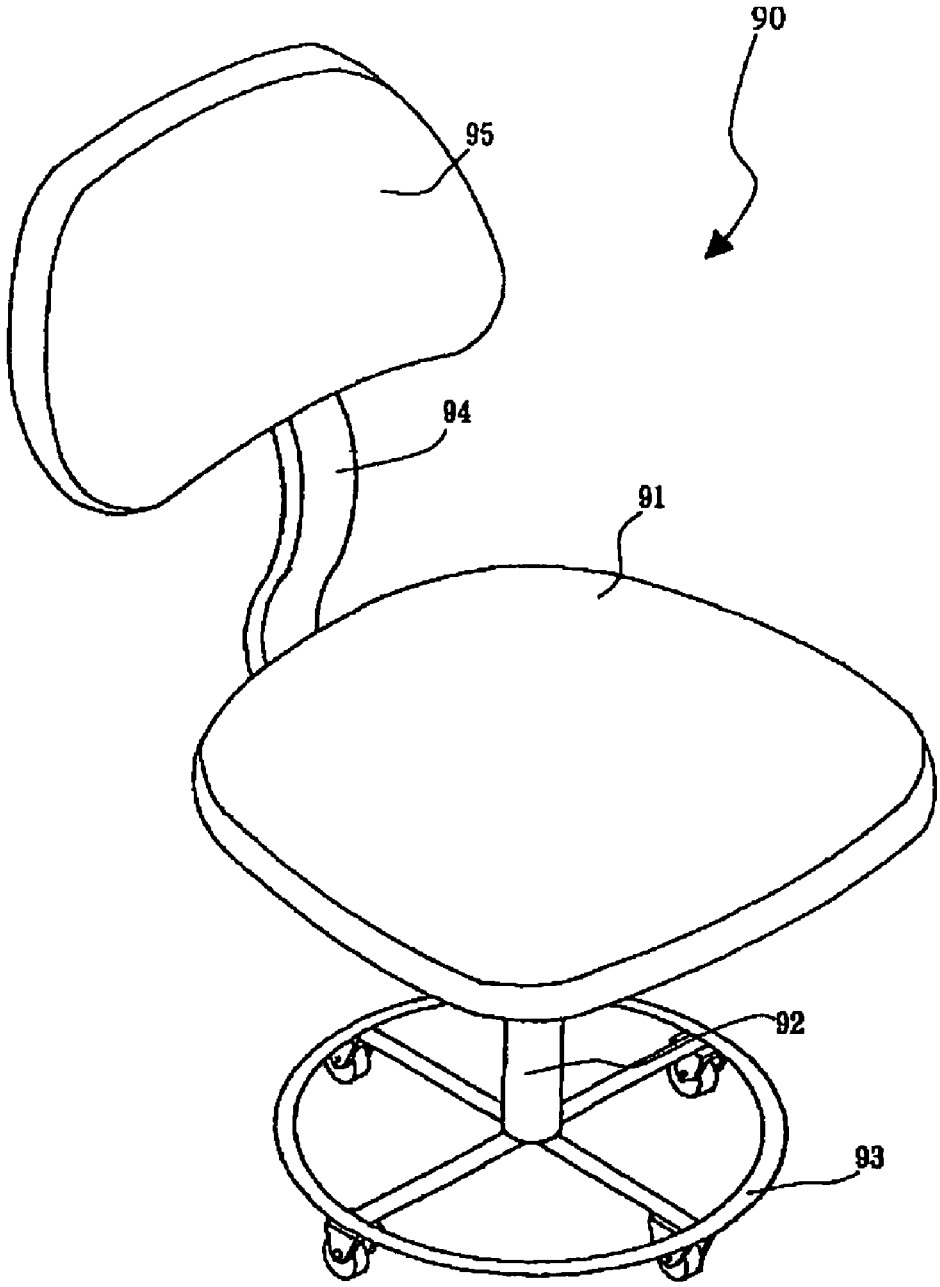
FIG. 1 Prior Art
FIG. 1 is a perspective view of a conventional office chair.
Figure 2:
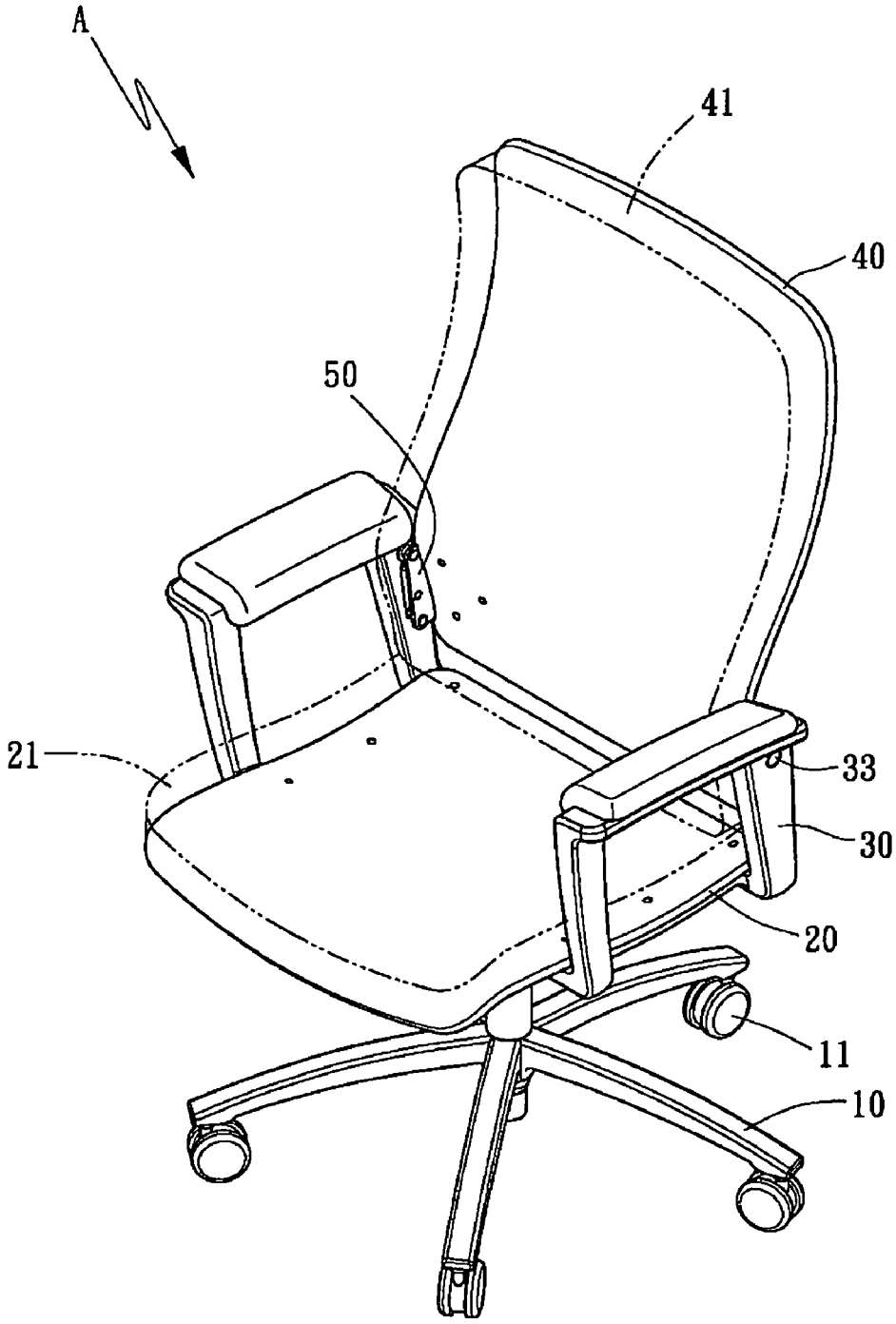
FIG. 2 is a perspective view of a folding and fixing structure of a chair backrest in accordance with the present invention.
Figure 3:
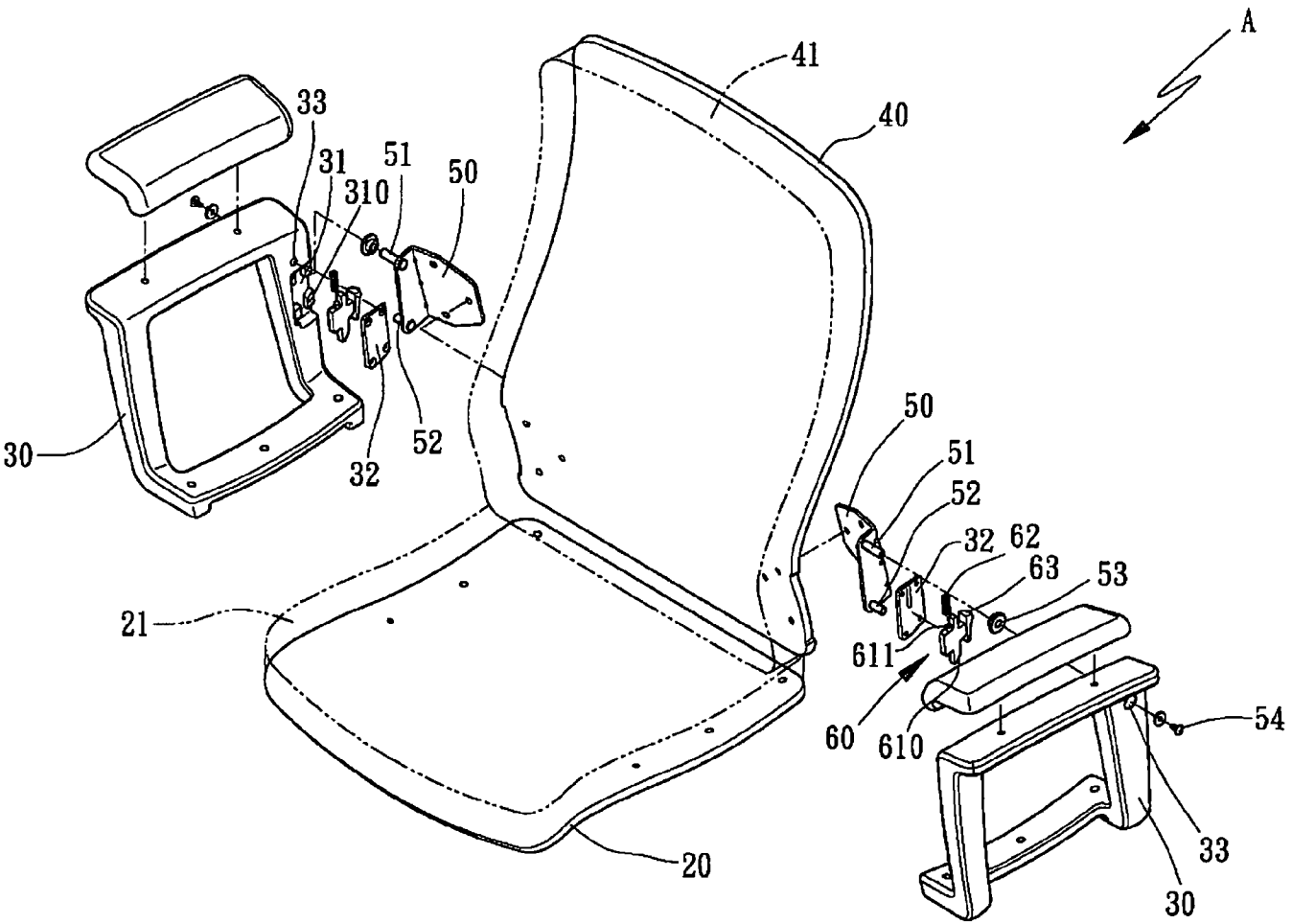
FIG. 3 is an exploded view of the folding and fixing structure of a chair backrest in accordance with the present invention.

Referring to FIGS. 2 and 3, a folding and fixing structure of a chair backrest in accordance with the present invention is a body A, which comprises a base 10 having a plurality of wheels 11. One end of the base 10 is mounted with a seat 20. A sponge cushion 21 is disposed on the seat 20, and two armrests 30 are fixed on bottom edges of two lateral sides of the seat 20. The above-mentioned structures are of conventional techniques and will not be described in detail.

The present invention is characterized in that: a backrest 40 is disposed between the armrests 30, and both sides of the backrest 40 adjacent to the armrests 30 are fixed with a pivotal member 50, respectively. One end of each pivotal member 50 is pivotally disposed on each armrest 30. A clutch structure 60 is disposed in each armrest 30, and by cooperating with the pivotal members 50 and the clutch structures 60, the backrest 40 can be folded or unfolded stably, such that the chair will occupy less space after being folded.

The armrests 30 are defined at a side of their opposite surfaces with a rectangular-shaped concave containing portion 31, respectively. Four corners of the containing portion 31 are disposed with a square-shaped block 310, respectively, and a cover 32 covers the blocks 310. The clutch structure 60 is received between the blocks 310. In addition, one end of each armrest 30 adjacent to the containing portion 31 is defined with a pivotal hole 33 for insertion of the pivotal member 50, respectively.

The backrest 40 is a laminar structure with a radian, and a sponge backrest pad 41 is disposed on the backrest 40. Both sides of the end of the backrest 40 adjacent to the seat 20 are provided for fixing the pivotal members 50.

The pivotal members 50 are L-shaped. One end surface of a long side of each pivotal member 50 is fixed to the backrest 40, and an elongated column-shaped pivotal portion 51 and a short column-shaped locking portion 52 are extended from one end surface of each pivotal member 50 adjacent to each armrest 30. The pivotal portion 51 is mounted with a circular and sheet-shaped washer 53, and the pivotal portion 51 is passed through the pivotal hole 33 of each armrest 30 and is threaded with a screw 54.

Each clutch structure 60 is disposed with a cross-shaped clutch member 61 that is movably received between the blocks 310 of the containing portion 31 of each armrest 30 and is located adjacent to the pivotal portion 51. One end of the clutch member 61 facing the seat 20 is formed with an inclined sliding portion 610, and one end surface of the clutch member 61 adjacent to the sliding portion 610 is protrudly disposed with a circular-shaped inserting portion 611 for insertion of a spiral spring 62. Further, the spring 62 is abutted against an inner wall of the containing portion 31. A thumb-shaped clutch portion 63 of each clutch member 61 is extended from an open side of the containing portion 31 of each armrest 30.

Figure 4:
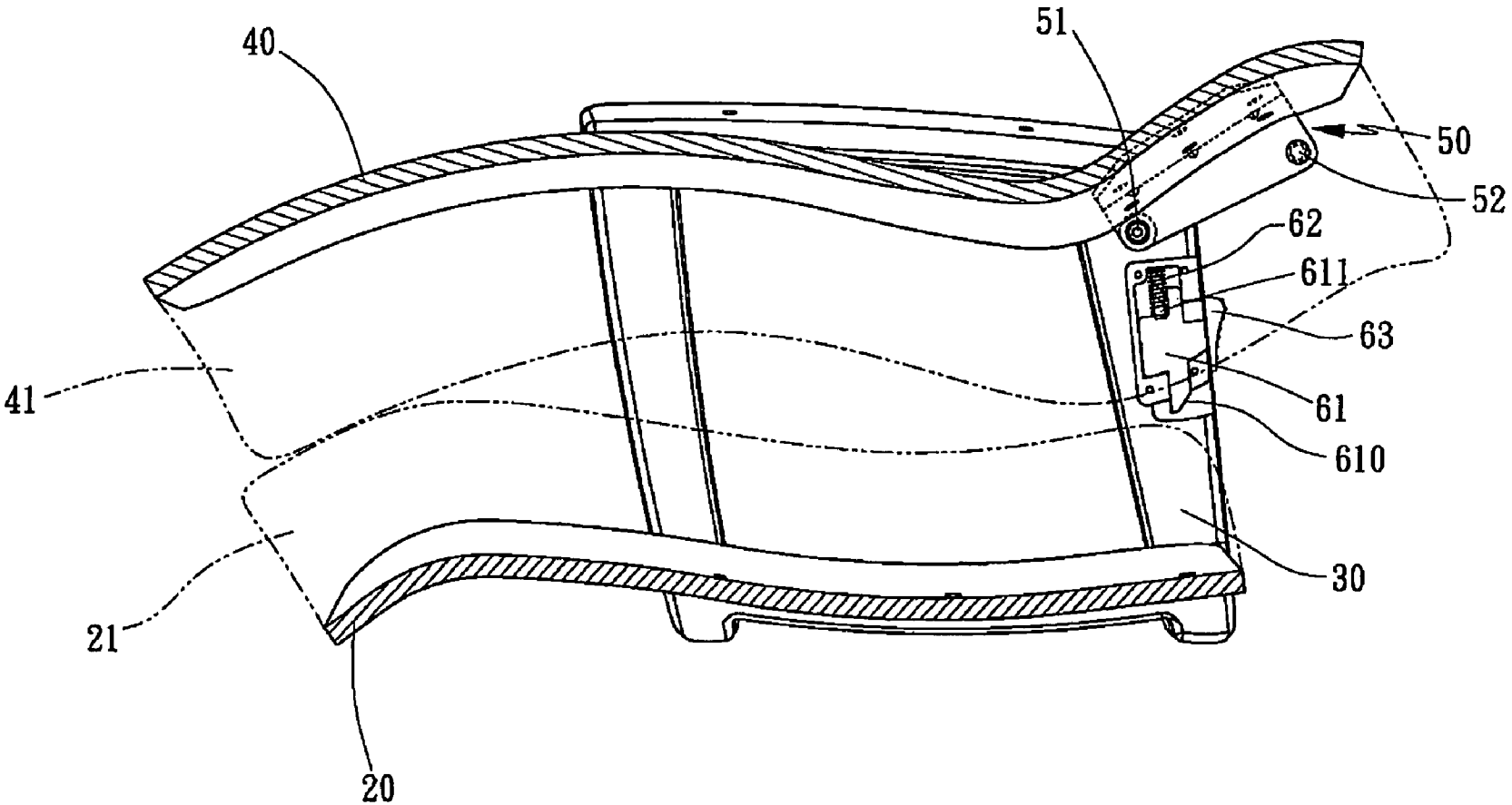
FIG. 4 is a partial illustrative view showing a first operation in accordance with the present invention.

FIGS. 4-7 show the folding and unfolding operations of the present invention. Referring to FIG. 4, the cushion 21 of the seat 20 and the backrest pad 41 of the backrest 40 are parallel to and abutted against each other between the armrests 30.

Figure 5:
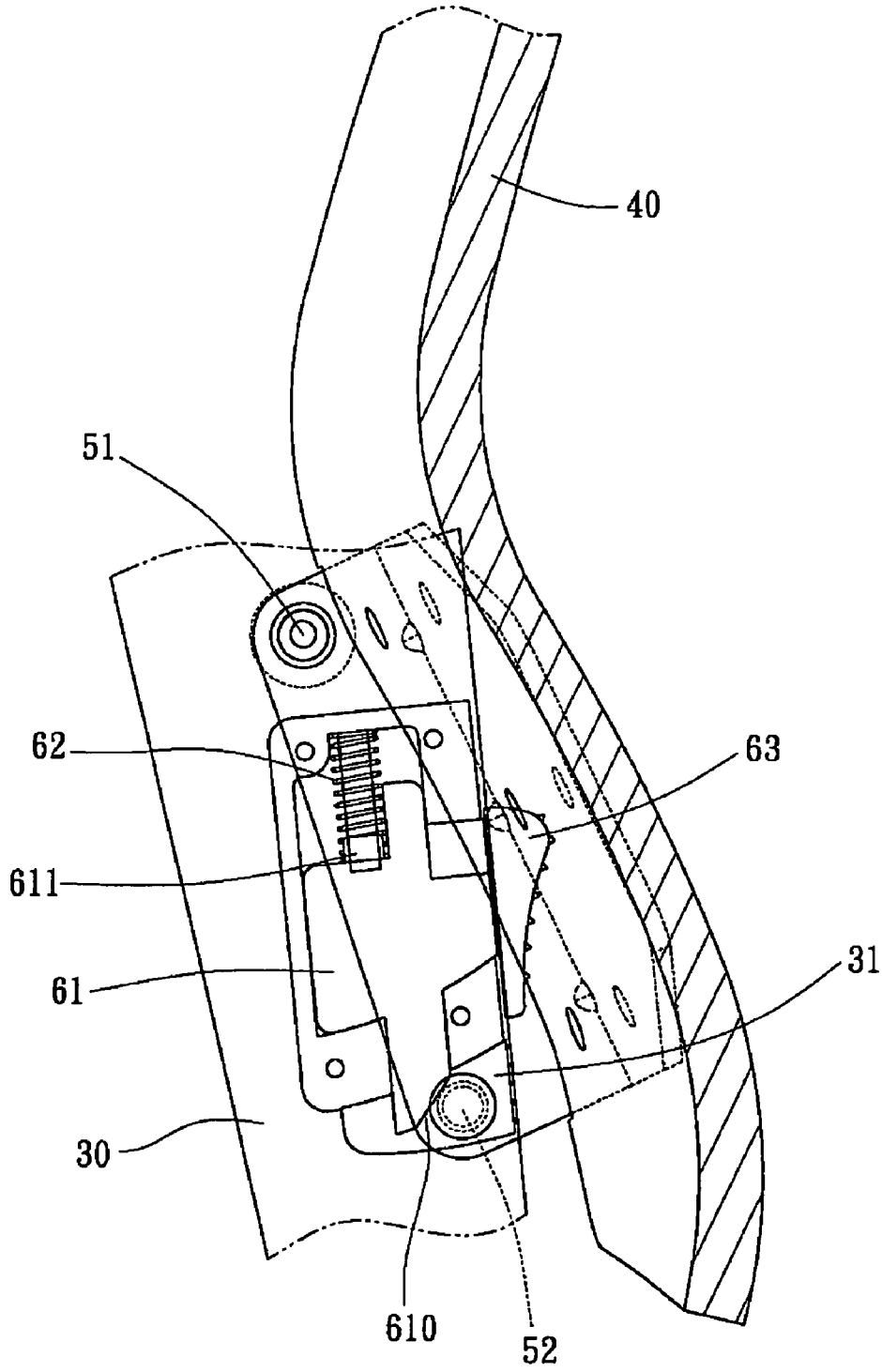
FIG. 5 is a partial illustrative view showing a second operation in accordance with the present invention.

Referring to FIG. 5, when the user pulls or pushes the backrest 40, the backrest 40 will rotate around and move with respect to the pivotal portions 51 of the pivotal members 50.

Figure 6:
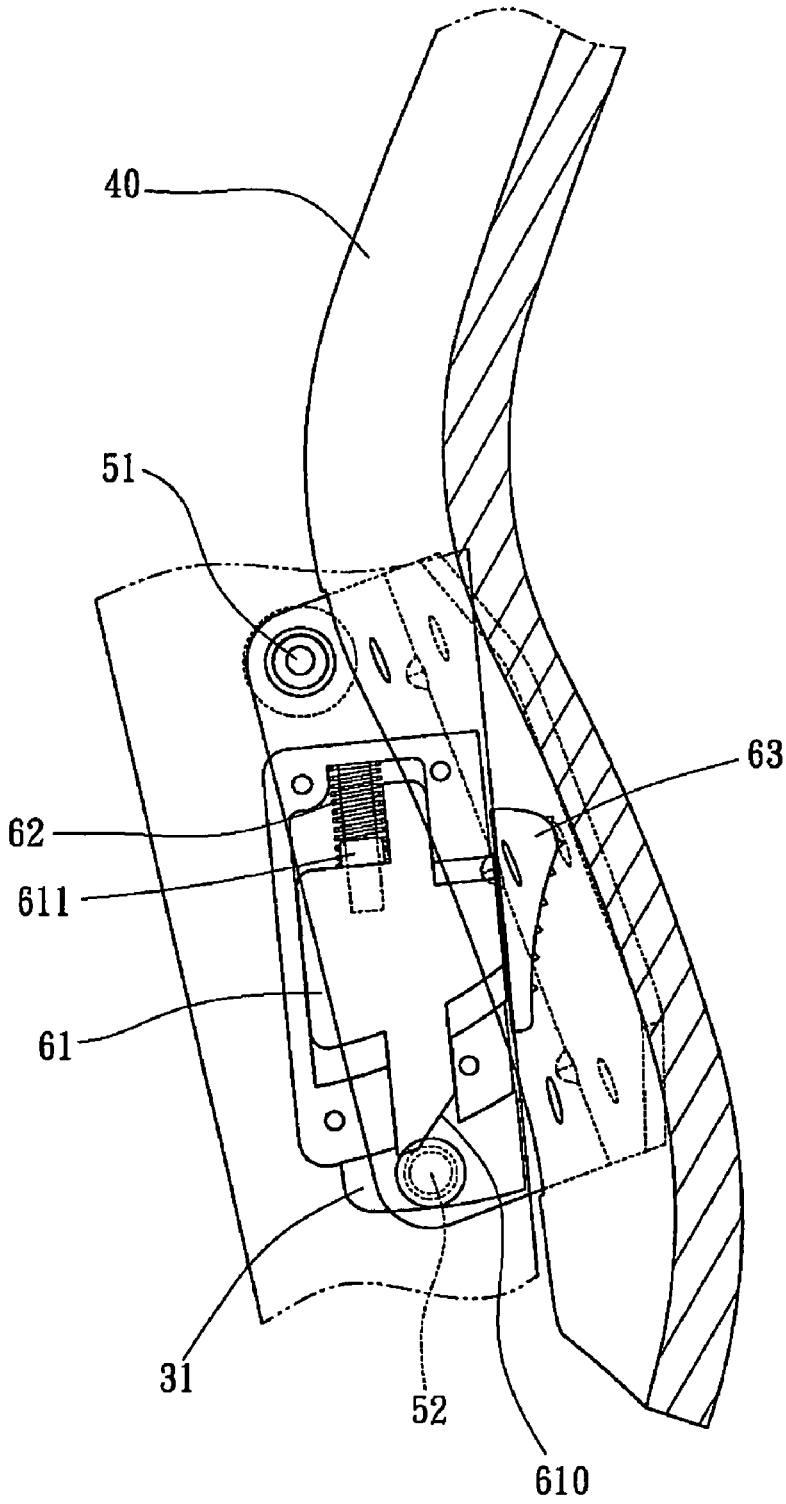
FIG. 6 is a partial illustrative view showing a third operation in accordance with the present invention.

Referring to FIG. 6, after the backrest 40 is pulled or pushed to a suitable position for the user's back to rest against, meanwhile, the locking portions 52 of the pivotal members 50 move towards the containing portions 31 of the armrests 30 and slide to the sliding portions 610 of the clutch members 61, such that the clutch members 61 will be pushed to one end by the sliding force of the locking portions 52 to make the locking portions 52 slide into the containing portions 31 and restrict by the sliding portions 610, thus maintaining the backrest 40 and the seat 20 in the suitable position for the user's back to rest against.

Figure 7:
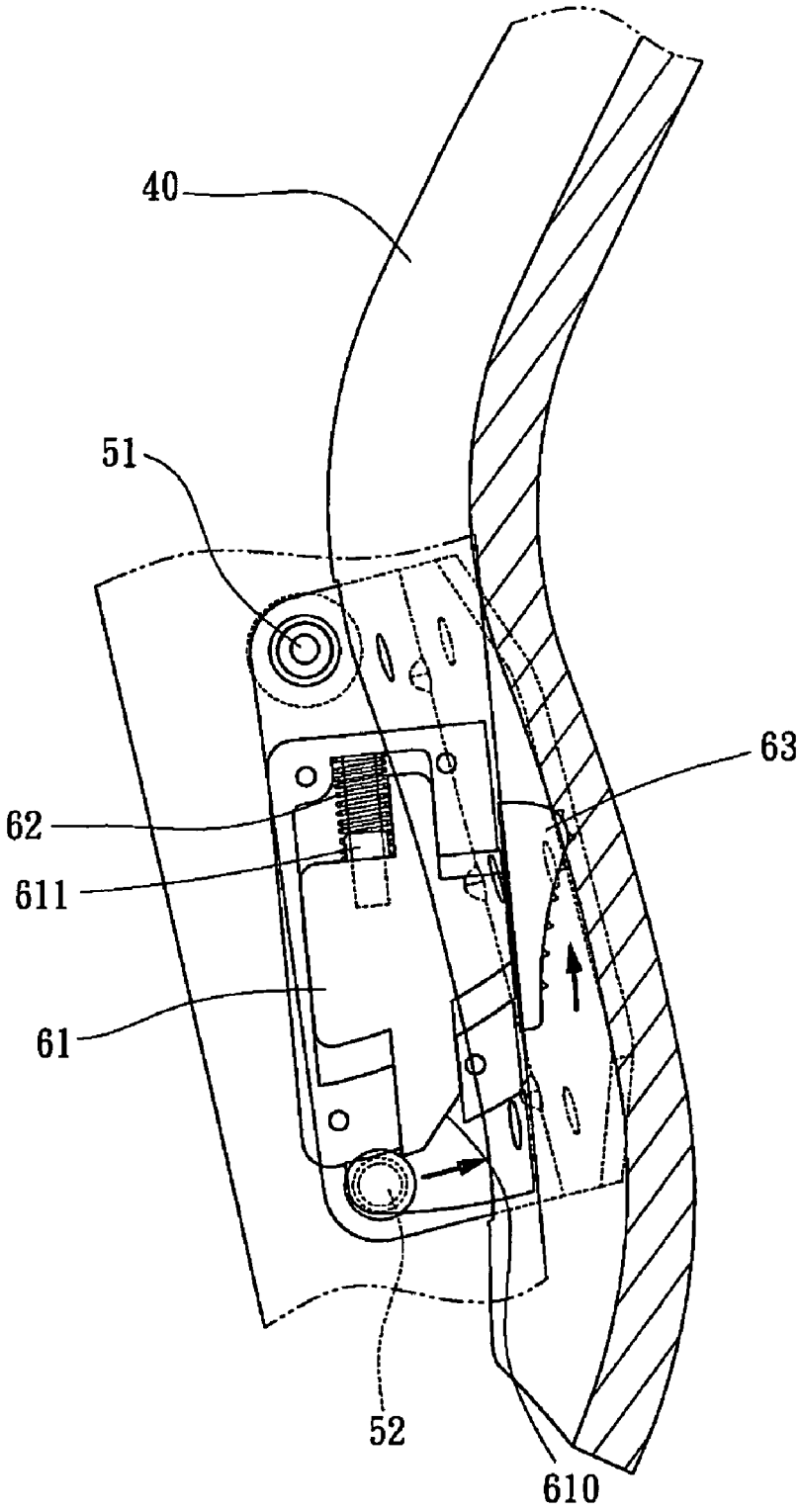
FIG. 7 is a partial illustrative view showing an unfolding operation in accordance with the present invention.

Referring to FIG. 7, the unfolding operation of the backrest 40 is shown, when the user pulls the clutch portions 63, the sliding portions 610 of the clutch members 61 are received in the containing portions 31. Then, the user pushes the backrest 40 to separate the locking portions 52 of the pivotal members 50 from the containing portions 31, such that the cushion 21 of the seat 20 and the backrest pad 41 of the backrest 40 are parallel to and abutted against each other between the armrests 30 as shown in FIG. 4.

With the above-mentioned structures, the backrest 40 can be folded or unfolded stably, such that the chair will occupy less space after being folded and it is easy to operate.

While we have shown and described various embodiments in accordance with the present invention, it should be clear to those skilled in the art that further embodiments may be made without departing from the scope of the present invention.

What is claimed is:

1. A folding and fixing structure of a chair backrest, comprising:

a backrest, both sides of an end of the backrest being fixed with a pivotal member having a pivotal portion and a locking portion, respectively;

two armrests, each pivotal portion of the backrest being pivotally disposed on each armrest, each armrest having a clutch member adjacent to the pivotal portion of the backrest, each clutch member being disposed with a clutch portion;

when the backrest and the armrests is rotatably moved with respect to the pivotal portions to a predetermined angle, the locking portions will be restricted by the clutch members disposed in the armrests or will be disengaged from clutch members by driving the clutch members with the clutch portions;

one side of each armrest is defined with a containing portion, each corner of the containing portion is disposed with a block, respectively, a cover covers the blocks of each containing portion, each clutch member is received between the blocks of each containing portion, and one end of each armrest adjacent to the containing portion is defined with a pivotal hole for insertion of the pivotal portion of each pivotal member of the backrest, respectively.

2. The folding and fixing structure of a chair backrest as claimed in claim 1, wherein a sponge backrest pad is disposed on the backrest.

3. The folding and fixing structure of a chair backrest as claimed in claim 1, wherein the pivotal members are L-shaped, one end surface of a long side of each pivotal member is fixed to the backrest, and the pivotal portion is elongated column-shaped and the locking portion is short column-shaped and they are extended from one end surface of each pivotal member adjacent to the corresponding armrest.

4. The folding and fixing structure of a chair backrest as claimed in claim 1, wherein one end of each clutch member is formed with a sliding portion for restricting the locking portion of each pivotal member, one end surface of each clutch member adjacent to the sliding portion is disposed with an inserting portion for insertion of a spring, and the spring is abutted against an inner wall of the containing portion.

* * * * *